US009435314B2

(12) United States Patent
Silva et al.

(10) Patent No.: US 9,435,314 B2
(45) Date of Patent: Sep. 6, 2016

(54) IGNITION COIL ASSEMBLY WITH EXTENSION FOR ELECTRICAL CONNECTION OF AN IGNITION PLUG

(71) Applicant: ELDOR CORPORATION S.P.A., Orsenigo (Como) (IT)

(72) Inventors: Stefano Silva, Orsenigo (IT); Pasquale Forte, Orsenigo (IT)

(73) Assignee: ELDOR CORPORATION S.P.A., Orsenigo (IT)

( * ) Notice: Subject to any disclaimer, the term of this patent is extended or adjusted under 35 U.S.C. 154(b) by 161 days.

(21) Appl. No.: 14/361,173

(22) PCT Filed: Nov. 22, 2012

(86) PCT No.: PCT/IB2012/002488
§ 371 (c)(1),
(2) Date: May 28, 2014

(87) PCT Pub. No.: WO2013/080013
PCT Pub. Date: Jun. 6, 2013

(65) Prior Publication Data

US 2014/0328002 A1 Nov. 6, 2014

(30) Foreign Application Priority Data

Nov. 29, 2011 (IT) ..... TO2011A1098

(51) Int. Cl.

| | |
|---|---|
| ***H01T 13/02*** | (2006.01) |
| ***F02P 3/02*** | (2006.01) |
| ***H01T 13/05*** | (2006.01) |
| *H01T 13/20* | (2006.01) |
| *H01T 13/41* | (2006.01) |
| *H01T 21/02* | (2006.01) |
| *H01T 13/40* | (2006.01) |

(52) U.S. Cl.
CPC ..... *F02P 3/02* (2013.01); *H01T 13/05* (2013.01); *H01T 13/20* (2013.01); *H01T 13/40* (2013.01); *H01T 13/41* (2013.01); *H01T 21/02* (2013.01)

(58) Field of Classification Search
USPC ..... 361/254; 313/131, 141, 13
See application file for complete search history.

(56) References Cited

U.S. PATENT DOCUMENTS

| | | | | |
|---|---|---|---|---|
| 3,178,661 A | | 4/1965 | Kirchgessner | |
| 3,965,879 A | | 6/1976 | Fitzner | |
| 5,146,906 A | * | 9/1992 | Agatsuma | H01T 13/44 123/634 |
| 5,535,726 A | * | 7/1996 | Wilmot | H01T 13/04 123/169 PA |

(Continued)

FOREIGN PATENT DOCUMENTS

| | | |
|---|---|---|
| GB | 2328324 | 2/1999 |
| WO | 2010149194 A1 | 12/2010 |

*Primary Examiner* — Danny Nguyen
(74) *Attorney, Agent, or Firm* — Pearne & Gordon LLP

(57) ABSTRACT

An ignition coil assembly with extension for electrical connection of an ignition plug of an endothermic engine, wherein the extension (10) comprises an essentially tubular hollow body (11) having a first end area (10.1) engaged, in a detachable manner, on the free end of an ignition plug, and electrical connections (10.26, 20, 10.36), provided for the transmission of high voltage electrical energy between an electrical/electronic member of the ignition coil and the ignition plug. The electrical connections (10.26, 20, 10.36) comprise at least one filter (20) of the high frequency electromagnetic disturbances produced by the operation of the coil, wherein a winding of electrically conductive wire surrounds a central core (20.3) in ferromagnetic material dispersed in a polymer base.

11 Claims, 4 Drawing Sheets

(56) References Cited

U.S. PATENT DOCUMENTS 6,137,390 A 10/2000 Tung et al.
7,355,500 B2 * 4/2008 Vom Schloss ..... F02P 13/00 336/192
2002/0180038 A1 12/2002 Oshima et al.
2007/0007844 A1 * 1/2007 Barbat ..... H02K 53/00 310/208
2008/0202484 A1 * 8/2008 Glatz ..... H01F 38/12 123/634

* cited by examiner

IGNITION COIL ASSEMBLY WITH EXTENSION FOR ELECTRICAL CONNECTION OF AN IGNITION PLUG

The present invention concerns an ignition coil assembly with extension for electrical connection of an ignition plug of an endothermic engine.

In the state of the art, ignition coils are known able to supply a potential difference to the electrodes of an ignition plug of an internal combustion engine, in order to trigger a spark for igniting the mixture of fuel and combustive agent inside a cylinder of the engine.

A known ignition coil assembly generally comprises:

- a portion shaped essentially in the form of a parallelepipedal box, containing the main electrical/electronic components necessary for operation of the coil and the connection means for the electrical supply. Said box-shaped portion furthermore comprises means for securing an endothermic engine to the engine block;
- a portion shaped essentially in the form of a hollow tubular body, so-called extension, secured, for example, by means of force coupling, to said box-shaped portion and containing the electrical/electronic means for transmitting to an ignition plug of the internal combustion engine the potential difference generated by the components of the coil contained in said box-shaped portion. The free end of said tubular body is engaged on the free end of the ignition plug, generally by means of detachable force coupling. In this way, the ignition coil assembly is secured on one side to the ignition plug, by means of the tubular body of the extension, and, on the other, to the engine block, for example, via screw means integral with the box-shaped portion of the ignition coil assembly and engaged by helical coupling in a corresponding threaded hole in the engine block. An example of the arrangement described here is illustrated in the international patent application number WO2010149194 by the same applicant.

In the solutions known in the state of the art, the box-shaped parallelepipedal portion typically contains two windings, one primary and one secondary, magnetically coupled. Low voltage electrical energy is passed through the primary winding, thus inducing a flow of high voltage energy in the secondary winding. This high voltage energy is conveyed towards an ignition device, for example an ignition plug. Said high voltage energy breaks a dielectric at the ends of the ignition plug, thus generating the spark that triggers the combustion in the combustion chamber of the endothermic engine. The transient nature of the phenomenon of breakage of the dielectric tends to create electromagnetic fields which can be critical for nearby electronic devices. Said electromagnetic fields have higher frequencies than those of the energy responsible for generation of the spark.

One method of reducing the above-mentioned problem is to insert a resistor in the hollow tubular body of the ignition coil assembly, in series with the secondary winding. Said resistor filters some electromagnetic frequencies, limiting the electromagnetic fields. Nevertheless, said method does not provide sufficient impedance in all the frequencies at which the filtering is required. Furthermore, the resistor increases the impedance also at low frequencies, i.e. at the frequencies at which energy is transferred from the ignition coil to the plug, reducing the quantity of energy actually supplied to the ignition plug.

To avoid the drawbacks due to the presence of the resistor, the patent GB 2328324 makes known an ignition coil assembly comprising, inside the hollow tubular body, an electrically conductive spring and a ferromagnetic element, arranged inside said electrically conductive spring. The electrically conductive spring is connected on one side to the ignition coil and on the other is connected to an ignition plug in order to transmit the electrical energy from the ignition coil to the ignition plug. The ferromagnetic element is produced, for example, in the form of a rod made of ferritic material. This implementation of an ignition coil assembly supplies a low impedance to the low frequency signals and a high impedance to the high frequency signals, reducing the emissions of electromagnetic disturbances.

However, also this latter solution does not provide a satisfactory reduction in emissions of the above-mentioned disturbances.

Furthermore, the rigid structure of the ferrite rod made known by the document GB 2328324 makes the ignition coil assembly particularly sensitive to mechanical and thermal shocks.

The present invention aims to remedy said drawbacks.

One object of the present invention is to provide an ignition coil assembly with extension for electrical connection of an ignition plug in an endothermic engine which is able to eliminate, or at least significantly reduce, the electrical/electromagnetic disturbances generated during normal use of the coil.

A further aim of the present invention is to provide an ignition coil assembly with extension for electrical connection of an ignition plug in an endothermic engine which is able to withstand thermal shocks, in particular during operation of the engine.

A further object of the present invention is to provide an ignition coil assembly with extension for electrical connection as indicated, which can withstand the mechanical stress induced by the engine during operation.

A further object of the present invention is to provide an ignition coil assembly with extension for electrical connection as said, which has a simplified structure, is easy to produce, simple to use and is inexpensive.

In view of said objects, the present invention provides an ignition coil assembly with extension for electrical connection of an ignition plug in an endothermic engine, the fundamental characteristic of which forms the subject of claim 1.

Further advantageous characteristics are listed in the dependent claims.

All the claims are understood to be reported here in full.

The present invention will be described in greater detail below with reference to the accompanying drawing, provided only by way of non-limiting example, in which.

Figure 1:
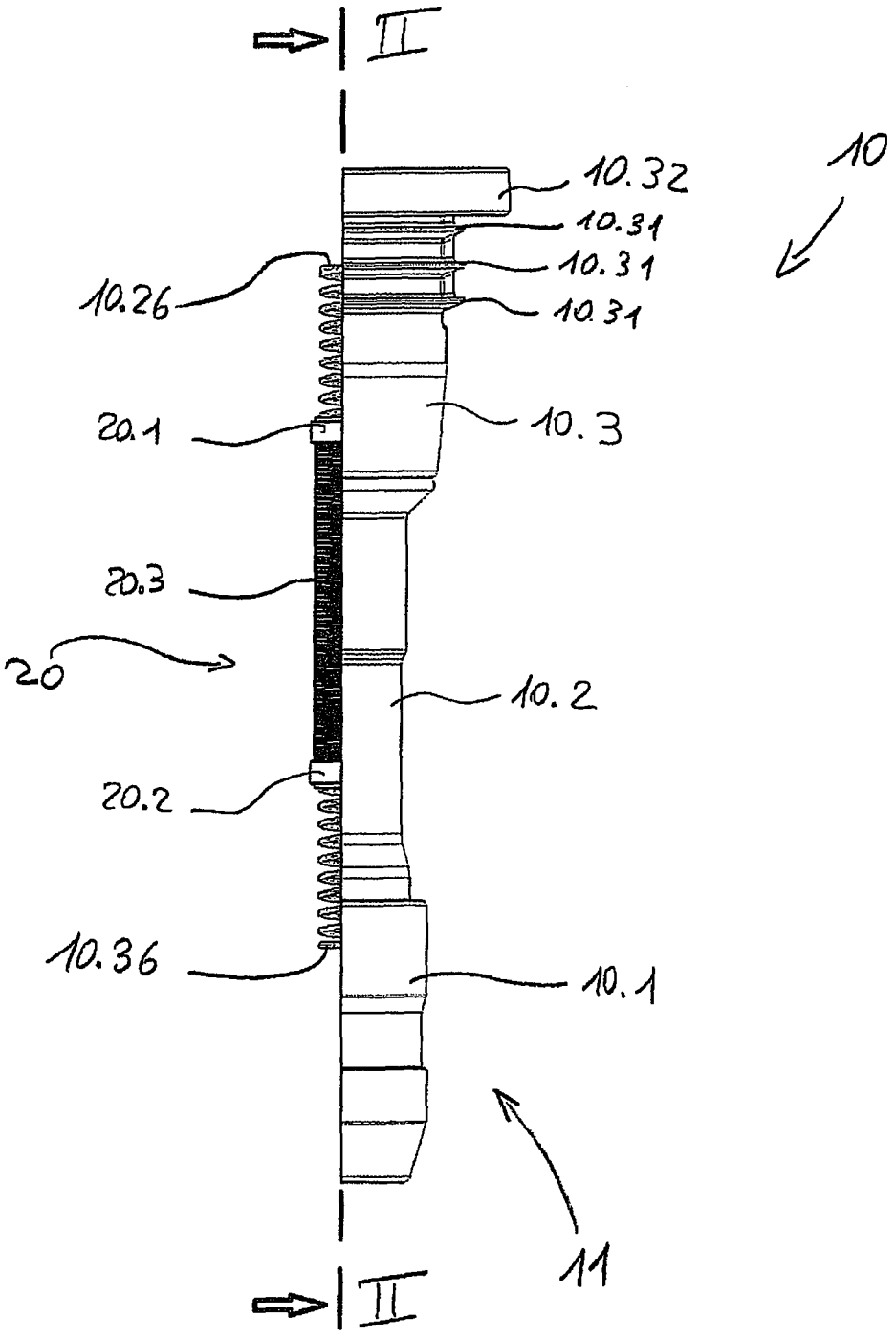
FIG. 1 is a front partially sectioned elevation view of an extension for ignition coil assembly for the electrical connection of an ignition plug in an endothermic engine, according to the present invention.

In the drawing, the number 10 indicates, as a whole, an extension for electrical connection of an ignition coil assembly of an ignition plug in an endothermic engine.

Said extension 10 essentially comprises (FIG. 1):

a long substantially cylindrical tubular body 11, with tubular wall having cross section of variable dimension, made of elastically flexible polymer material.

Said tubular body 11 is connected in a detachable manner to a box-shaped container (known in the state of the art and not illustrated) containing, mainly, a primary winding, a second secondary winding adapted to generate the high voltage electrical energy for creation of the spark at the ends of an ignition plug and the necessary electrical connection means.

Figure 2:
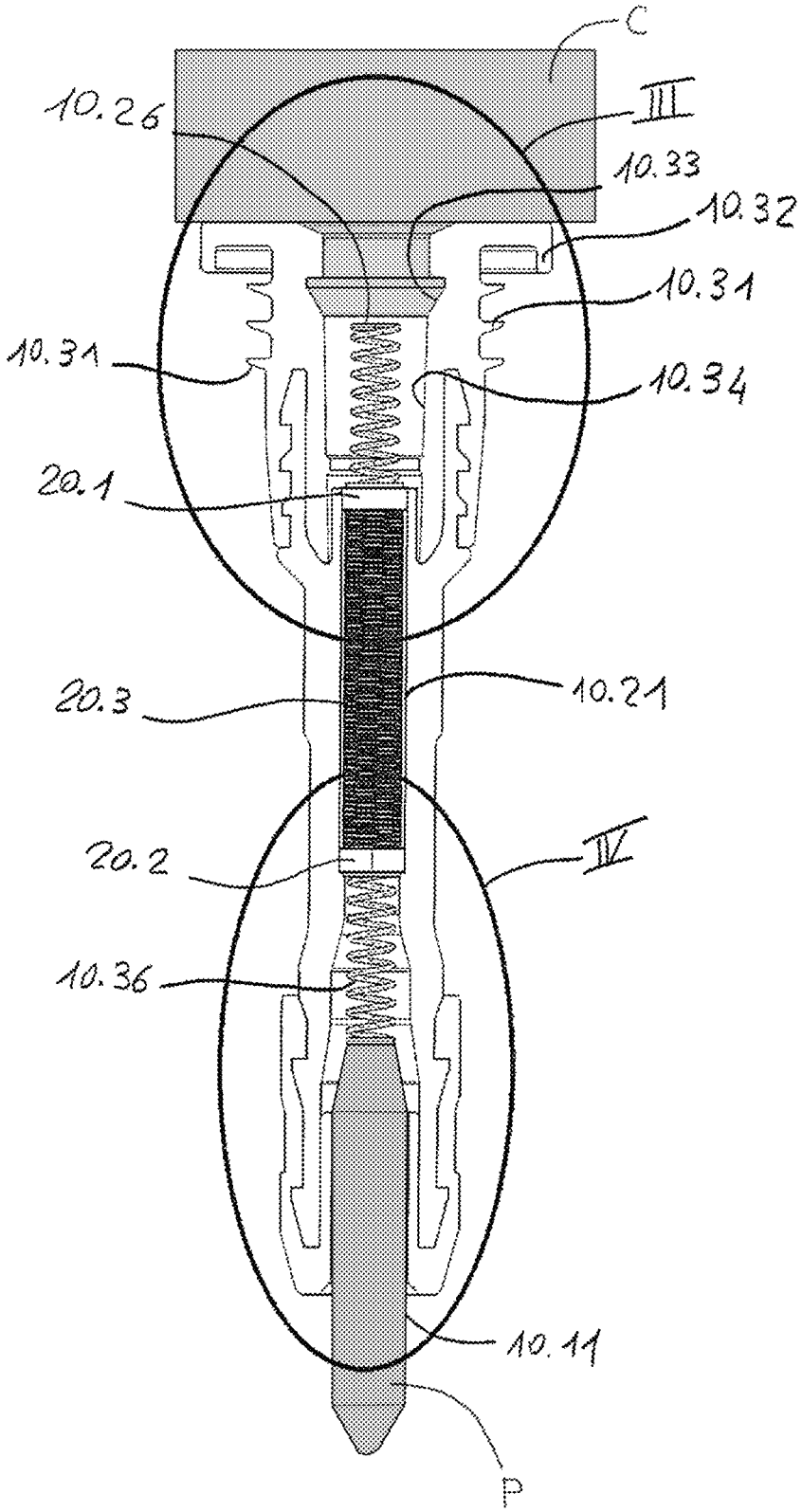
FIG. 2 is a section view, on a larger scale, according to line II-II of FIG. 1.
Figure 3:
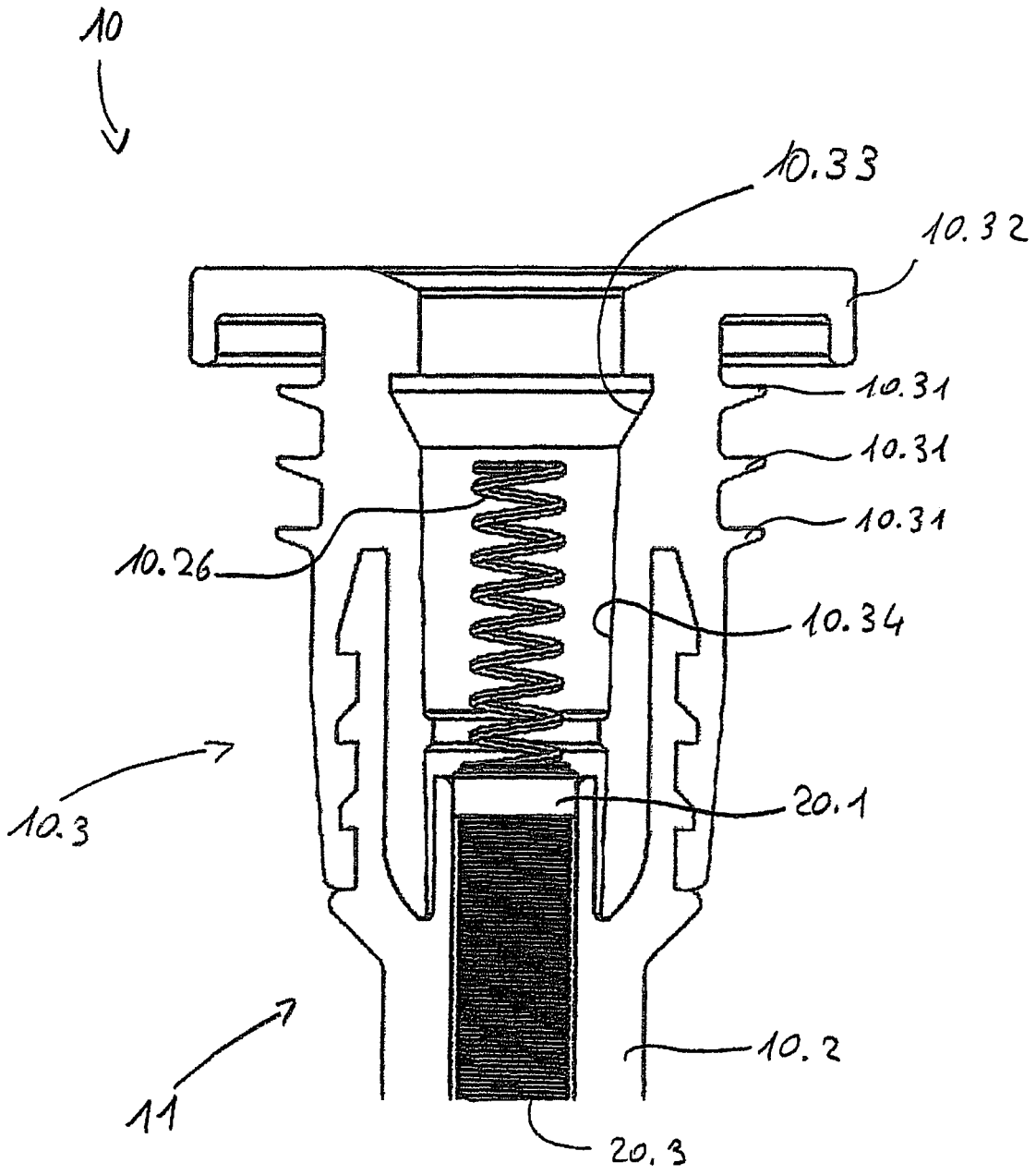
FIG. 3 is a detail view, on a larger scale, of the detail III of FIG. 2.
Figure 4:
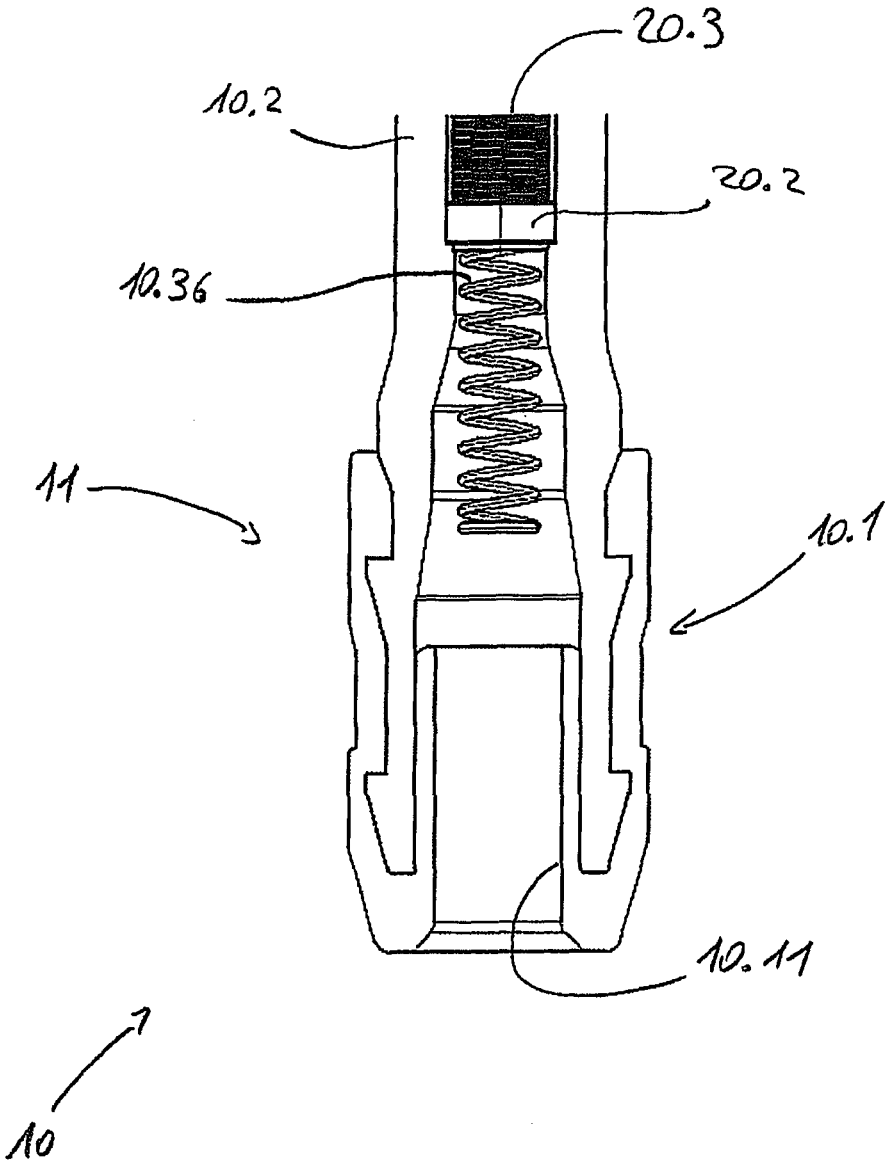
FIG. 4 is a detail view, on a larger scale, of the detail IV of FIG. 2.

Said tubular body 11 (FIGS. 1 and 2) has substantially three contiguous axial areas, i.e.

- a first free end area 10.1, tapered towards the edge of the free end and having a respective axial through cavity 10.11,
- a second end area 10.3, opposite the first one, substantially cylindrical and having a respective axial through cavity 10.34,
- a substantially cylindrical intermediate area 10.2, with greater axial extension with respect to said first and second end areas, and having a respective axial through cavity 10.21.

Said second end area 10.3 has, on its outer surface, three coaxial annular retaining lips 10.31 which, in the configuration for use of an ignition coil equipped with extension 10 according to the present invention, are inserted by exerting a slight force into a respective well of the cylinder head of an endothermic engine (not illustrated), to retain in position said tubular body 11, and a free end lip 10.32 juxtaposed and folded back against said box-shaped container, known and not illustrated. Furthermore, said second end area 10.3 has, on the inner surface, an annular groove 10.33 permanently coupled with the known box-shaped container, thus making the known box-shaped container and the extension 10 integral.

It will be noted that said axial through cavities 10.11, 10.21, 10.34 of the respective axial areas 10.1, 10.2, 10.3 of the extension 10 are coaxial and intercommunicating, forming one single continuous axial through cavity.

A first electrically conductive helical spring 10.26 (FIG. 2) is housed coaxially inside the axial through cavity 10.34 of the second end 10.3, while a second electrically conductive helical spring 10.36 is housed coaxially partly inside the axial through cavity 10.11 of the first end 10.1 and partly inside the axial cavity 10.22 of the intermediate area 10.2.

In the remaining part of the cavity 10.21 of the intermediate area 10.2 and in part of the axial cavity 10.34 of the end area 10.3, a coaxial cylindrical filter means 20 is housed. Said filter means 20 comprises:

- an electrical conductor means for upper coupling 20.1, for example a first conductor cap, which provides the physical and electrical coupling between the conductor spring 10.26 and the filter element 20;
- an electrical conductor means for lower coupling 20.2, for example a second conductor cap, which provides the physical and electrical connection between the second conductor spring 10.36 and the filter element 20;
- a central part 20.3 comprising a core made of ferromagnetic material, for example ferrite, dispersed in a polymer, for example PPS (polyphenylene sulphide), around which a means is wound made of electrically conductive wire in the form of a coiled helical filament, if necessary coated with a film of semiconductive material. Said central part 20.3 is elastically flexible.

In the operating configuration of the ignition coil, the extension 10 is mechanically connected, by means of the annular coupling cavity 10.33, to the box-shaped container (not illustrated) of the ignition coil assembly, and electrically, by means of said first spring 10.26, to the electrical/electronic means necessary for correct operation of the ignition coil, while the terminal of an ignition plug (known per se and not illustrated) is housed inside the axial cavity 10.11 of the first end area 10.1 of the extension 10, in close electrical and mechanical contact with the free end of said second spring 10.36.

In this way, in the engine operating phase, low voltage electrical energy is generated inside the primary winding housed in said box of the coil assembly and induces high voltage electrical energy in the secondary winding. Said high voltage electrical energy is then transmitted to the first electrically conductive spring 10.26 and, via the first cap 20.1, is conducted by means of the winding made of electrically conductive wire wound on said central part 20.3 of the filter means 20. Then, via the second cap 20.2 and the second spring 10.36, the high voltage electrical energy is transferred to the ignition plug.

The presence of said filter means 20 along the high voltage energy path means that there are no significant energy losses in transfer of the latter from the windings located in the box of the coil assembly to the plug, while the desired reduction of electromagnetic disturbances at high frequency is obtained. Due to correct sizing of the components of said filter means 20, or due to the correct quantity of ferritic material dispersed in the polymer constituting the central core and the correct number of coils of the electrically conductive wire wound around said central core 20.3, the correct impedance value is obtained which allows reduction of the electromagnetic disturbances, without jeopardising the transfer of energy from the coil to the plug.

Furthermore, the particular shape of said filter means 20 allows an extension 10 to be obtained able to absorb, without any particular problems, the thermal and mechanical stress transmitted to it during normal operation of the ignition coil.

Lastly, said filter means 20 has characteristics such as to minimise the construction and installation costs, and to facilitate and speed up the assembly procedures inside the extension 10.

The invention claimed is:

1. An ignition coil assembly with extension for electrical connection of an ignition plug of an endothermic engine, wherein said extension (10) comprises an essentially tubular hollow body (11), which is secured to a container (C) containing the electrical/electronic means of the ignition coil for generation of a high voltage electrical energy to transmit to an ignition plug (P) for the triggering of sparks secured to the engine block of said engine, a first end area (10.1) of said tubular body (11) is engaged, in a detachable manner, on the free end of said ignition plug, and electrical connection means (10.26, 20, 10.36), provided for the transmission of the high voltage electrical energy between said electrical/electronic means of the ignition coil and said ignition plug, are contained in said tubular body (11), wherein said means for electrical connection (10.26, 20, 10.36) comprise at least one filter means (20) of the high frequency electromagnetic disturbances produced by the operation of said coil, a winding of electrically conductive wire surrounds a central core (20.3) in ferromagnetic material dispersed in a polymer base and at least one spring in good electrically conductive material (10.26, 10.36) is arranged and electrically connected between said electrically conductive winding of said at least one filter means (20) and said coil, respectively between said electrically conductive winding of said at least one filter means (20) and said plug.

2. The ignition coil assembly with extension (10) for electrical connection according to claim 1, characterized in that said at least one filter means (20) comprises a coupling means (20.1, 20.2), in good electrically conductive material, which produces the electromechanical connection of said winding of electrically conductive wire with said at least one spring in good electrically conductive material (10.26, 10.36).

3. The ignition coil assembly with extension (10) for electrical connection according to claim 2, characterized in that said coupling means (20.1, 20.2) comprises at least one cap, in good electrically conductive material, electrically connected with respect to said winding and secured at one end of said central core (20.3) of said at least one filter means (20) and electrically and mechanically connected with respect to said at least one spring (10.26, 10.36).

4. The ignition coil assembly with extension (10) for electrical connection according to claim 1, characterized in that said winding of electrically conductive wire of said at least one filter means (20) comprises a coating in semiconductive material.

5. The ignition coil assembly with extension (10) for electrical connection according to claim 1, characterized in that said polymer base of said central core (20.3) comprises a polyphenylene sulphide.

6. The ignition coil assembly with extension (10) for electrical connection according to claim 1, wherein said tubular body (11) comprises three contiguous axial areas:

a first end area (10.1) having an axial through cavity (10.11), in which the free end of said ignition plug is engaged;

a second end area (10.3), having an axial through cavity (10.34) and which is secured to said container containing the electrical/electronic means of said ignition coil, and an intermediate area (10.2), having an intermediate axial through cavity (10.21); and wherein said three axial cavities (10.11, 10.21, 10.34) form a single continuous axial through cavity;

characterized in that said at least one filter means (20) is permanently housed in at least one of said axial cavities (10.11, 10.21, 10.34).

7. The ignition coil assembly with extension (10) for electrical connection according to claim 6, characterized in that said at least one filter means (20) is substantially rod-shaped and is permanently housed at least in the axial cavity (10.21) of said intermediate area (10.2), while each of the other two axial cavities (10.11, 10.34) of said tubular body (11) contains a respective spring (10.26, 10.36) in good electrically conductive material, said springs being connected electrically to said at least one filter means (20) and to the electrical/electronic means of said ignition coil, the one and of said ignition plug, the other.

8. The ignition coil assembly with extension (10) for electrical connection according to claim 1, characterized in that said at least one filter means (20) is co-moulded with said hollow tubular body (11) of said extension (10).

9. The ignition coil assembly with extension (10) for electrical connection according to claim 1, characterized in that said hollow tubular body (11) of said extension (10) is elastically flexible and said at least one filter means (20) is elastically flexible.

10. An ignition coil assembly with extension for electrical connection of an ignition plug of an endothermic engine, wherein said extension (10) comprises an essentially tubular hollow body (11), which is secured to a container (C) containing the electrical/electronic means of the ignition coil for generation of a high voltage electrical energy to transmit to an ignition plug (P) for the triggering of sparks secured to the engine block of said engine, a first end area (10.1) of said tubular body (11) is engaged, in a detachable manner, on the free end of said ignition plug, and electrical connection means (10.26, 20, 10.36), provided for the transmission of the high voltage electrical energy between said electrical/electronic means of the ignition coil and said ignition plug, are contained in said tubular body (11), wherein said means for electrical connection (10.26, 20, 10.36) comprise at least one filter means (20) of the high frequency electromagnetic disturbances produced by the operation of said coil, a winding of electrically conductive wire surrounds a central core (20.3) in ferromagnetic material dispersed in a polymer base and at least one spring in good electrically conductive material (10.26, 10.36) is arranged and said tubular body (11) comprises three contiguous axial areas:

a first end area (10.1) having an axial through cavity (10.11), in which the free end of said ignition plug is engaged;

a second end area (10.3), having an axial through cavity (10.34) and which is secured to said container containing the electrical/electronic means of said ignition coil, and an intermediate area (10.2), having an intermediate axial through cavity (10.21);

wherein said three axial cavities (10.11, 10.21, 10.34) form a single continuous axial through cavity and said at least one filter means (20) is permanently housed in at least one of said axial cavities (10.11, 10.21, 10.34).

11. An ignition coil assembly with extension for electrical connection of an ignition plug of an endothermic engine, wherein said extension (10) comprises an essentially tubular hollow body (11), which is secured to a container (C) containing the electrical/electronic means of the ignition coil for generation of a high voltage electrical energy to transmit to an ignition plug (P) for the triggering of sparks secured to the engine block of said engine, a first end area (10.1) of said tubular body (11) is engaged, in a detachable manner, on the free end of said ignition plug, and electrical connection means (10.26, 20, 10.36), provided for the transmission of the high voltage electrical energy between said electrical/electronic means of the ignition coil and said ignition plug, are contained in said tubular body (11), wherein said means for electrical connection (10.26, 20, 10.36) comprise at least one filter means (20) of the high frequency electromagnetic disturbances produced by the operation of said coil, a winding of electrically conductive wire surrounds a central core (20.3) in ferromagnetic material dispersed in a polymer base and at least one spring in good electrically conductive material (10.26, 10.36) is arranged and said hollow tubular body (11) of said extension (10) is elastically flexible and said at least one filter means (20) is elastically flexible.

* * * * *